US010636562B2

(12) United States Patent
Kim et al.

(10) Patent No.: US 10,636,562 B2
(45) Date of Patent: Apr. 28, 2020

(54) COIL ELECTRONIC COMPONENT AND METHOD OF MANUFACTURING THE SAME

(71) Applicant: SAMSUNG ELECTRO-MECHANICS CO., LTD., Suwon-si, Gyeonggi-do (KR)

(72) Inventors: Ki Seok Kim, Suwon-si (KR); Myung Sam Kang, Suwon-si (KR); Ye Jeong Kim, Suwon-si (KR); Kwang Hee Kwon, Suwon-si (KR); Sa Yong Lee, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/662,025

(22) Filed: Jul. 27, 2017

(65) Prior Publication Data

US 2018/0122557 A1 May 3, 2018

(30) Foreign Application Priority Data

Oct. 27, 2016 (KR) ..... 10-2016-0141302

(51) Int. Cl.

| | |
|---|---|
| ***H01F 5/00*** | (2006.01) |
| ***H01F 27/28*** | (2006.01) |
| ***H01F 27/29*** | (2006.01) |
| ***H01F 41/04*** | (2006.01) |
| ***H01F 41/10*** | (2006.01) |

(Continued)

(52) U.S. Cl.

CPC ..... *H01F 27/2804* (2013.01); *H01F 17/0013* (2013.01); *H01F 27/29* (2013.01); *H01F 41/041* (2013.01); *H01F 41/10* (2013.01); *H01F 17/0033* (2013.01); *H01F 2017/004* (2013.01);

(Continued)

(58) Field of Classification Search

USPC ..... 336/200

See application file for complete search history.

(56) References Cited

U.S. PATENT DOCUMENTS 8,451,083 B2 * 5/2013 Okumura ..... H01F 5/003 336/200
2005/0253677 A1 * 11/2005 Ito ..... H01F 17/0013 336/200

(Continued)

FOREIGN PATENT DOCUMENTS

JP 2006-332147 A 12/2006
JP 2011-077157 A 4/2011

(Continued)

OTHER PUBLICATIONS

Eglish translation of JP2009152347 (Year: 2009).*

*Primary Examiner* — Ronald Hinson

(74) *Attorney, Agent, or Firm* — Morgan, Lewis & Bockius LLP

(57) ABSTRACT

A coil electronic component includes: a plurality of coil layers including, respectively, coil patterns and connection patterns disposed outside the coil patterns and forming a stacking structure; conductive vias connecting the coil patterns formed on different levels to each other; and external electrodes electrically connected to the plurality of coil layers. The coil patterns of at least two of the plurality of coil layers may have the same shape and be electrically connected to each other in parallel.

20 Claims, 7 Drawing Sheets

(51) Int. Cl.
*H01F 17/00* (2006.01)
*H01F 17/04* (2006.01)

(52) U.S. Cl.
CPC ..... *H01F 2017/048* (2013.01); *H01F 2027/2809* (2013.01)

(56) References Cited

U.S. PATENT DOCUMENTS

| | | | | |
|---|---|---|---|---|
| 2010/0109829 | A1* | 5/2010 | Sugiyama | H01F 17/0013 336/200 |
| 2010/0270891 | A1* | 10/2010 | Kohda | H03H 9/1021 310/344 |
| 2011/0074535 | A1 | 3/2011 | Banno | |
| 2012/0105188 | A1 | 5/2012 | Lim et al. | |
| 2014/0253277 | A1* | 9/2014 | Takezawa | H01F 27/2804 336/200 |
| 2014/0292466 | A1* | 10/2014 | Watanabe | H01F 27/29 336/192 |
| 2016/0351321 | A1* | 12/2016 | Lyoo | H01F 27/2804 |
| 2017/0323726 | A1* | 11/2017 | Sasaki | H01G 4/30 |

FOREIGN PATENT DOCUMENTS

| | | | |
|---|---|---|---|
| JP | 2013-098554 | A | 5/2013 |
| JP | 2013-191863 | A | 9/2013 |
| KR | 10-1210374 | B1 | 4/2011 |
| KR | 10-1158220 | B1 | 5/2012 |

* cited by examiner

COIL ELECTRONIC COMPONENT AND METHOD OF MANUFACTURING THE SAME

CROSS-REFERENCE TO RELATED APPLICATION(S)

This application claims benefit of priority to Korean Patent Application No. 10-2016-0141302 filed on Oct. 27, 2016 in the Korean Intellectual Property Office, the disclosure of which is incorporated herein by reference in its entirety.

TECHNICAL FIELD

The present disclosure relates to a coil electronic component.

BACKGROUND

A coil electronic component or an inductor, a component constituting an electronic circuit, together with a resistor and a capacitor, is formed by winding coils around a ferrite core or printing the coils on the ferrite core and forming electrodes on both end surfaces of the core, and is used to remove noise or is used as a component constituting an LC resonant circuit. An inductor may be variously classified as one of a multilayer inductor, a winding type inductor, a thin film type inductor, or the like, depending on a form of the coil.

In general, an inductor has a form in which coils are embedded in a body formed of an insulating material, and recently, in accordance with demand for miniaturization of elements and diversification of functions, attempts to obtain a high efficiency product having excellent electrical characteristics have been continuously conducted.

SUMMARY

An aspect of the present disclosure may provide a coil electronic component having a reduced thickness to be advantageous in terms of miniaturization and having high inductance. Another aspect of the present disclosure may provide a method of effectively manufacturing the coil electronic component having the abovementioned structure.

According to an aspect of the present disclosure, a coil electronic component may include: a plurality of coil layers including, respectively, coil patterns and connection patterns disposed outside the coil patterns and forming a stacking structure; conductive vias connecting the coil patterns formed on different levels to each other; and external electrodes electrically connected to the plurality of coil layers. The coil patterns of at least two of the plurality of coil layers may have the same shape and be electrically connected to each other in parallel.

The coil electronic component may further include a first coil part and a second coil part, respectively including the plurality of coil layers, wherein coil patterns of the coil layers belonging to the first coil part have the same shape, and coil patterns of the coil layers belonging to the second coil part have the same shape.

The coil patterns of the coil layers belonging to the first coil part may have a shape different from that of the coil patterns of the coil layers belonging to the second coil part.

The coil patterns of the coil layers belonging to the first coil part and the coil patterns of the coil layers belonging to the second coil part may be linearly symmetrical with respect to each other.

Each of the plurality of coil layers may include a pair of connection patterns, and the coil patterns of the coil layers belonging to the first coil part may be connected to one of the pair of connection patterns and the coil patterns of the coil layers belonging to the second coil part may be connected to the other of the pair of connection patterns.

The external electrodes may include first and second external electrodes of which polarities are different from each other, and the connection patterns of the coil layers belonging to the first coil part may be connected to the first external electrode and the connection patterns of the coil layers belonging to the second coil part may be connected to the second external electrode.

The coil layers belonging to the first coil part may be electrically connected to each other in parallel, and the coil layers belonging to the second coil part may be electrically connected to each other in parallel.

The first coil part and the second coil part may be electrically connected to each other in series.

The conductive vias may connect connection patterns formed on the different levels to each other.

Each of the plurality of coil layers may include a pair of connection patterns.

The pair of connection patterns may be disposed in positions opposing each other to face each other.

One connection pattern of the pair of connection patterns may be electrically connected to one of the external electrodes, and another connection pattern of the pair of connection patterns may be electrically isolated from the remaining portion of the coil layer and electrically connected to another of the external electrodes.

The coil electronic component may further include insulating layers covering the coil patterns and the connection patterns.

The coil electronic component may further include a core part filling a hole penetrating through the insulating layers and including a magnetic material.

The core part may cover upper and lower portions of the plurality of coil layers.

Distances between any immediately adjacent coil layers in a direction along which the plurality of coil layers are stacked are substantially the same as each other.

According to another aspect of the present disclosure, a method of manufacturing a coil electronic component may include: forming a plurality of unit laminates including coil patterns, connection patterns disposed outside the coil patterns, insulating layers covering the coil patterns, and conductive vias penetrating through the insulating layers and connected to the coil patterns; stacking the plurality of unit laminates to correspond to one another; and forming external electrodes on external surfaces of a stacking structure of the plurality of unit laminates. The coil patterns of at least two of a plurality of coil layers may have the same shape and be electrically connected to each other in parallel.

The forming of the plurality of unit laminates may include: forming the coil patterns on a surface of a carrier layer; forming the insulating layers to cover the coil patterns and the connection patterns; and forming the conductive vias penetrating through the insulating layers and connected to the coil patterns.

The forming of the plurality of unit laminates may further include separating the carrier layer from the unit laminate.

Stacking the plurality of unit laminates may be performed after forming the plurality of unit laminate layers

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will be described in detail with reference to the accompanying drawings.

Figure 1:
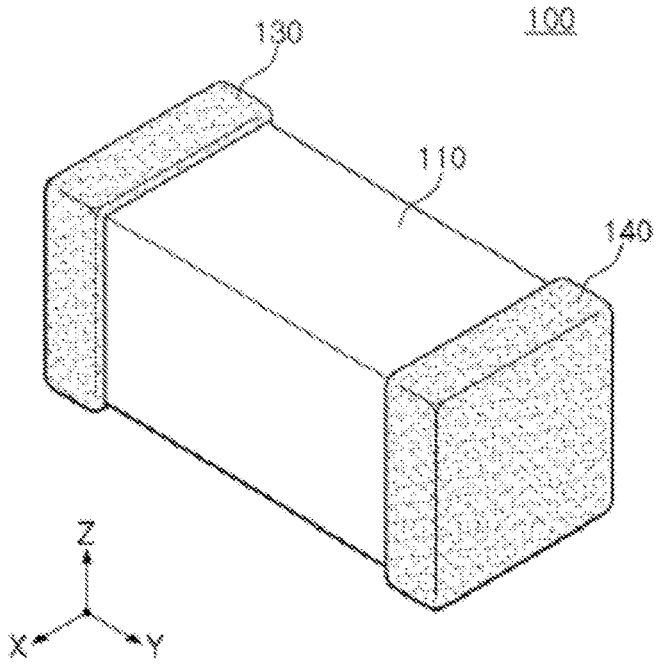
FIG. 1 is a schematic perspective view illustrating a coil electronic component according to an exemplary embodiment in the present disclosure.
Figure 2:
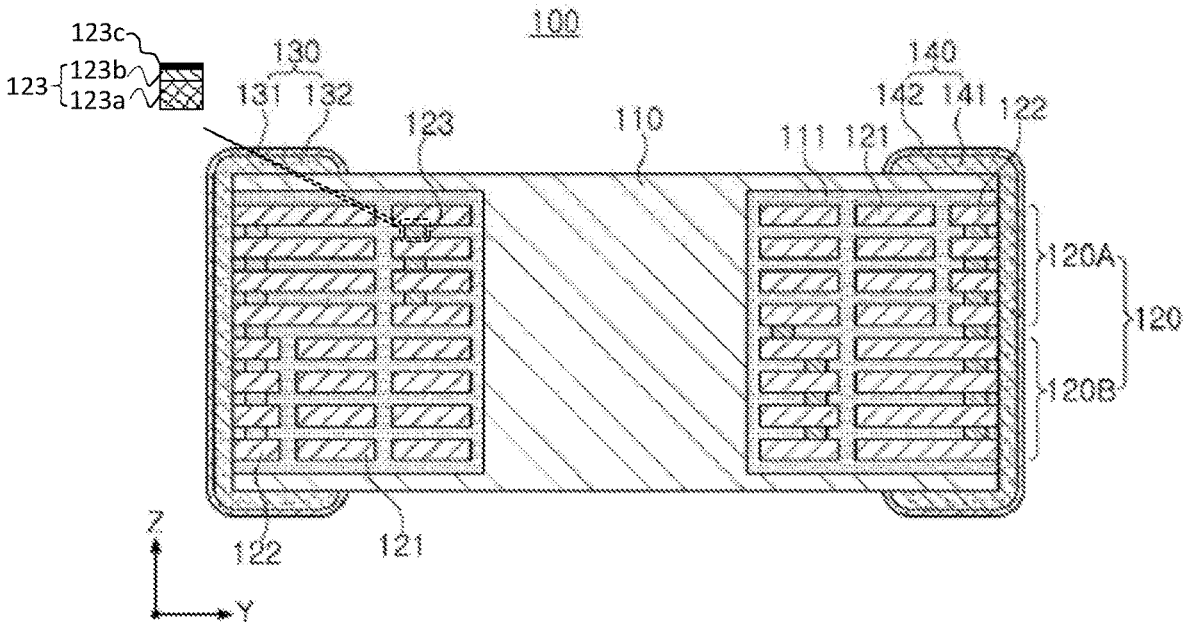
FIG. 2 is a cross-sectional view of the coil electronic component of FIG. 1, depicted so that coil patterns, connection patterns, and conductive vias are visible.
Figure 3:
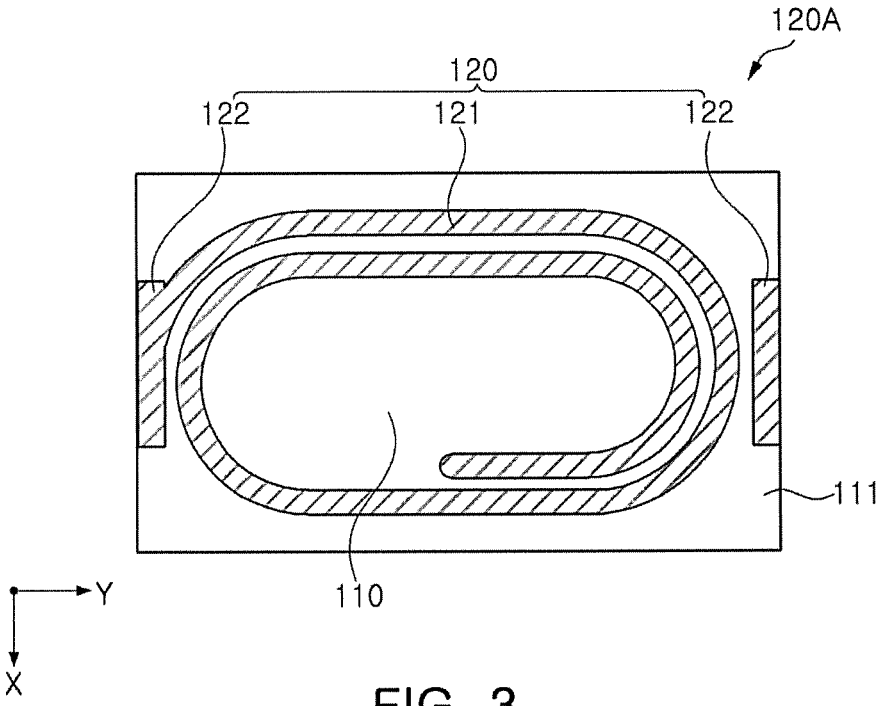
FIGS. 3 and 4 are plan views illustrating coil layers that may be used in the coil electronic component of FIG. 1 in each position.
Figure 4:
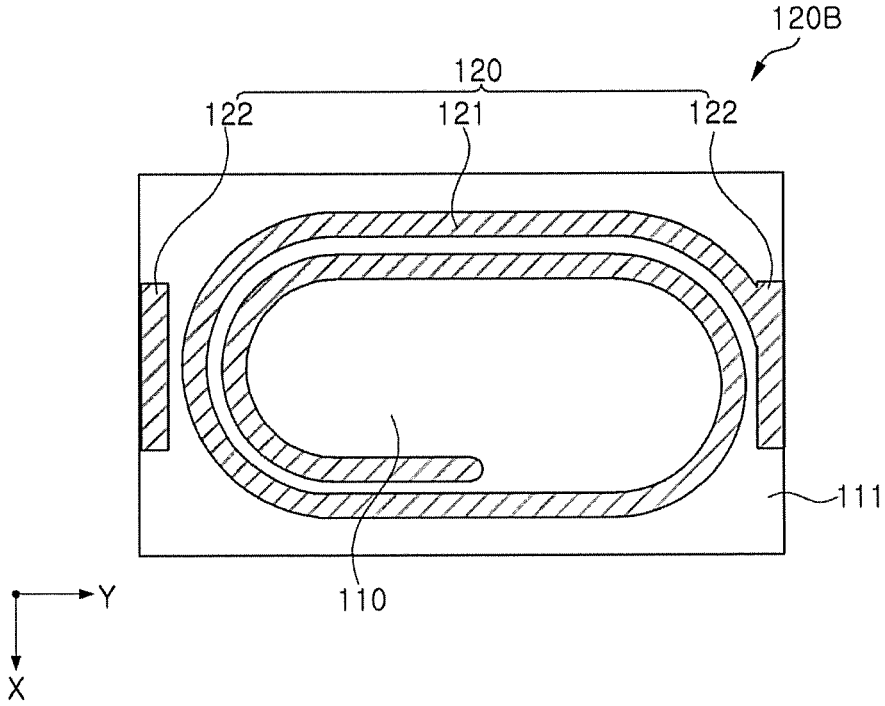

FIG. 1 is a schematic perspective view illustrating a coil electronic component according to an exemplary embodiment in the present disclosure. FIG. 2 is a cross-sectional view of the coil electronic component of FIG. 1 along Y-Z plane, depicted so that coil patterns, connection patterns, and conductive vias are visible. FIGS. 3 and 4 are plan views illustrating coil layers that may be used in the coil electronic component of FIG. 1 in each position.

Referring to FIGS. 1 and 2, a coil electronic component 100 may include a plurality of coil layers 120 stacked in Z direction, conductive vias 123, and external electrodes 130 and 140 disposed in Y direction. Coil patterns 121 included in at least two of the plurality of coil layers 120 may have the same shape, and may be connected to each other in parallel. In the present exemplary embodiment, a structure in which the coil electronic component 100 includes first and second coil parts 120A and 120B respectively including four coil layers 120 having the same shape, as described below, will be described. The coil electronic component 100 that may have a reduced thickness and high inductance to thus be used as a power inductor, or the like, may be implemented by such a parallel connection structure of multilayer coil patterns 121. The respective components constituting the coil electronic component 100 will be described hereinafter.

The plurality of coil layers 120 may include coil patterns 121 and connection patterns 122 disposed outside the coil patterns 121, and insulating layers 111 may cover the coil patterns 121 and the connection patterns 122. An appropriate material selected from among materials that may be used as a material of one component forming a body of an inductor may be used as a material of the insulating layer 111. For example, a resin, ceramic, ferrite, or the like, may be used as the material of the insulating layer 111. In the present exemplary embodiment, a photosensitive insulating material may be used as the material of the insulating layer 111. Therefore, fine patterns may be implemented through a photolithography process. That is, the insulating layer 111 may be formed of the photosensitive insulating material, and the conductive vias 123, the coil patterns 121, the connection patterns 122, and the like, may thus be finely formed to contribute to miniaturization and performance improvement of the coil electronic component 100. To this end, for example, a photosensitive organic material or a photosensitive resin may be included in the insulating layer 111. In addition, an inorganic component such as $SiO_2/Al_2O_3/BaSO_4$/Talc, or the like, may be further included as a filler component of the insulating layer 111. Distances between any immediately adjacent coil layers 120 in Z axis along which the plurality of coil layers 120 are stacked on each other may be substantially the same as each other. Distances being substantially the same means that the distances being the same, or means that the distances are intended to be configured to be the same as each other but are not the same as each other due to design, manufacturing, measurement errors/margins caused by unperfected design, manufacturing, and measurement conditions. Distances between any immediately adjacent coil layers 120 in Z axis along which the plurality of coil layers 120 are stacked on each other may be substantially the same as each other. The material between any immediately adjacent coil layers 120 in Z axis along which the plurality of coil layers 120 are stacked is the same, i.e., the material for forming the insulating layer 111.

The coil patterns 121 may have a coil form in a stacking direction of the coil layers 120 as illustrated in FIGS. 3 and 4. In this case, as in a form illustrated in FIG. 2, the coil patterns 121 formed on different levels may be connected to each other through the conductive vias 123.

The connection patterns 122 may be disposed between the coil patterns 121 and the external electrodes 130 and 140 to allow stable electrical connections between the coil patterns 121 and the external electrodes 130 and 140 to be secured, and the connection patterns 122 provided on the respective coil layers 120 to be thus formed on different levels may be connected to each other by the conductive vias 123.

The coil patterns 121 and the connection patterns 122 may be obtained by patterning a metal having high conductivity, and may be formed by, for example, a tenting process using copper (Cu) foil etching, a semi-additive process (SAP) using copper plating, a modified semi-additive process (MSAP), or the like. A metal for forming the coil patterns 121 and the connection patterns 122 may be copper (Cu), silver (Ag), palladium (Pd), aluminum (Al), nickel (Ni), titanium (Ti), gold (Au), platinum (Pt), or mixtures thereof. The coil patterns 121 and the connection patterns 122 may also be formed by a process such as plating, sputtering, or the like, in addition to such a patterning manner.

The conductive vias 123 may connect to the coil patterns 121 disposed on different layers to each other. The conductive via 123 may be formed of a plurality of plating layers, and may have, for example, a stacking structure of a Cu layer 123*a* and an Sn layer 123*b*. In this case, an intermetallic compound 123*c* may be formed on an interface between the conductive via 123 and the coil pattern 121. In a case of using general build-up type printed circuit board (PCB) technology, a conductive via is formed of the same metal as that of a circuit pattern. Therefore, an intermetallic compound does not appear. However, in a case of using a collective stacking method as described below, a material constituting the coil pattern 121 and a material such as Sn configuring the conductive via 123 may be diffusion-bonded to each other, such that the coil pattern 121 and the conductive via 123 may be effectively electrically connected to each other. However, the conductive via 123 is not limited to being formed in a multilayer structure, and may also be formed as a single layer structure.

In the present exemplary embodiment, as in a form illustrated in FIG. 2, a coil part 120 may be divided into the first and second coil parts 120A and 120B each including a plurality of coil layers 120. In this case, coil patterns 121 of the coil layers 120 belonging to the first coil part 120A may have the same shape, for example, a shape illustrated in FIG. 3. Likewise, coil patterns 121 of the coil layers 120 belonging to the second coil part 120B may have the same shape, for example, a shape illustrated in FIG. 4. In addition, the coil patterns 121 of the coil layers 120 belonging to the first coil part 120A may have a shape different from that of the coil patterns 121 of the coil layers 120 belonging to the second coil part 120B. In detail, as illustrated in FIGS. 3 and 4, the coil patterns 121 of the coil layers 120 belonging to the first coil part 120A and the coil patterns 121 of the coil layers 120 belonging to the second coil part 120B may have line symmetry with respect to each other. However, the coil electronic component 100 is not limited to including a plurality of coil parts 120A and 120B, but may also include only one coil part.

As described above, the coil layers 120 belonging to the first coil part 120A may be electrically connected to each other in parallel, and the coil layers 120 belonging to the second coil part 120B may also be electrically connected to each other in parallel. In addition, the first coil part 120A may be electrically connected to the second coil part 120B in series. These parallel and series connection structures may be obtained by the conductive vias 123 connecting the coil patterns 121 and the connection patterns 122 disposed on different levels to each other. As in the present exemplary embodiment, the plurality of coil layers 120 belonging to the same coil parts 120A and 120B are connected to each other in parallel, and an inductance may thus be increased, and in the present exemplary embodiment, a substrate is not required, and a thickness of the coil electronic component 100 may be reduced as compared to a power inductor according to the related art in which a thick plating layer is formed and a substrate and coil patterns are formed.

Forms of the coil layers 120 will be described in more detail with reference to FIGS. 3 and 4. Each coil layer 120 may include a pair of connection patterns 122 in order to be connected to the external electrodes 130 and 140. In this case, the pair of connection patterns 122 may be disposed in positions opposing each other to face each other. In addition, the coil patterns 121 of the coil layers 120 belonging to the first coil part 120A may be connected to one (a coil pattern disposed at the left of FIG. 3) of the pair of connection patterns 122, and the coil patterns 121 of the coil layers 120 belonging to the second coil part 120B may be connected to the other (a coil pattern disposed at the right of FIG. 4) of the pair of connection patterns 122.

In addition, when the external electrodes 130 and 140 are a first external electrode 130 and a second external electrode 140, respectively, the connection patterns 122 of the coil layers 120 belonging to the first coil part 120A may be connected to the first external electrode 130, and the connection patterns 122 of the coil layers 120 belonging to the second coil part 120B may be connected to the second external electrode 140.

Meanwhile, as described above, the external electrodes 130 and 140 electrically connected to the plurality of coil layers 120 may be configured as a pair, and may be disposed in positions opposing each other. In this case, as in a form illustrated in FIG. 2, the external electrodes 130 and 140 may have a multilayer structure. For example, the external electrodes 130 and 140 may include first layers 131 and 141 and second layers 132 and 142, respectively. The first layers 131 and 141 may be pre-plating patterns in contact with the plurality of coil layers 120 and formed of Cu, or the like. Alternatively, the first layers 131 and 141 may have a form of flexible electrodes. In this case, the flexible electrodes may alleviate impact, or the like, acting on the coil electronic component 100. To this end, the flexible electrodes may have, for example, a structure including an insulating resin and conductive particles. The second layers 132 and 142 may include a plurality of plating layers and in more detail. For example, a first layer of the plurality of plating layers may be a nickel (Ni) plating layer, and a second layer of the plurality of plating layers may be a tin (Sn) plating layer.

The coil electronic component 100 according to the present exemplary embodiment may further include a core part 110. The core part 110 may be formed by filling a hole penetrating through the insulating layers 111 with a magnetic material, or the like, as in a form illustrated in FIG. 2, and magnetic characteristics of the coil electronic component 100 may be improved by such a core part 110. In this case, the core part 110 may extend to upper and lower portions to cover upper and lower portions of the plurality of coil layers 120, as in a form illustrated in FIG. 2.

An example of a method of manufacturing the coil electronic component having the abovementioned structure will hereinafter be described with reference to FIGS. 5 through 10.

As described above, the coil electronic component described above may be manufactured by collectively stacking a plurality of unit laminates to correspond to one another. As an example, as in a form illustrated in FIGS. 5 through 8, a unit laminate including insulating layers 111, coil patterns 121, connection patterns 122, conductive vias 123, and the like, may be manufactured.

Figure 5:
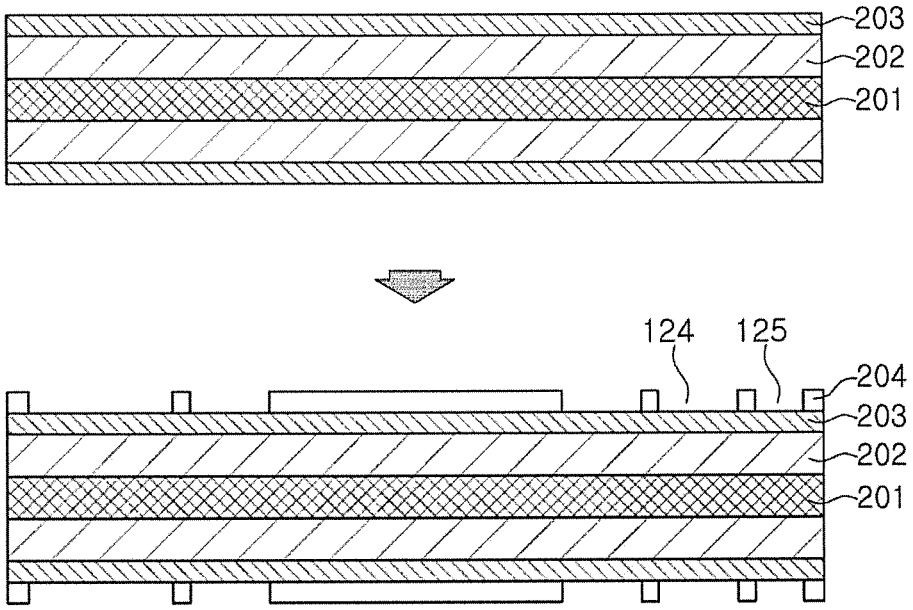
FIGS. 5 through 10 are views illustrating a method of manufacturing a coil electronic component according to an exemplary embodiment in the present disclosure.

First, as in a form illustrated in FIG. 5, a carrier layer 201 may be prepared, and mask patterns 204 may be formed on the carrier layer 201. Coil layers 120 including the coil patterns 121 and the connection patterns 122 may be formed. The carrier layer 201 may be formed of a thermosetting resin, and copper foil layers 202 and 203 may be formed on a surface of the carrier layer 201. Therefore, the carrier layer 201 may be provided in a form of a copper clad laminate. The copper foil layers 202 and 203 may serve as seed layers for forming the coil patterns 121 and the connection patterns 122 or serve to easily separate the carrier layer 201 in a subsequent process, and may be omitted according to another exemplary embodiment. The mask patterns 204 may have open regions 124 and 125 having a shape corresponding to those of the coil patterns 121 and the connection patterns 122, and may be obtained by, for example, exposing and developing a photosensitive film.

Figure 6:
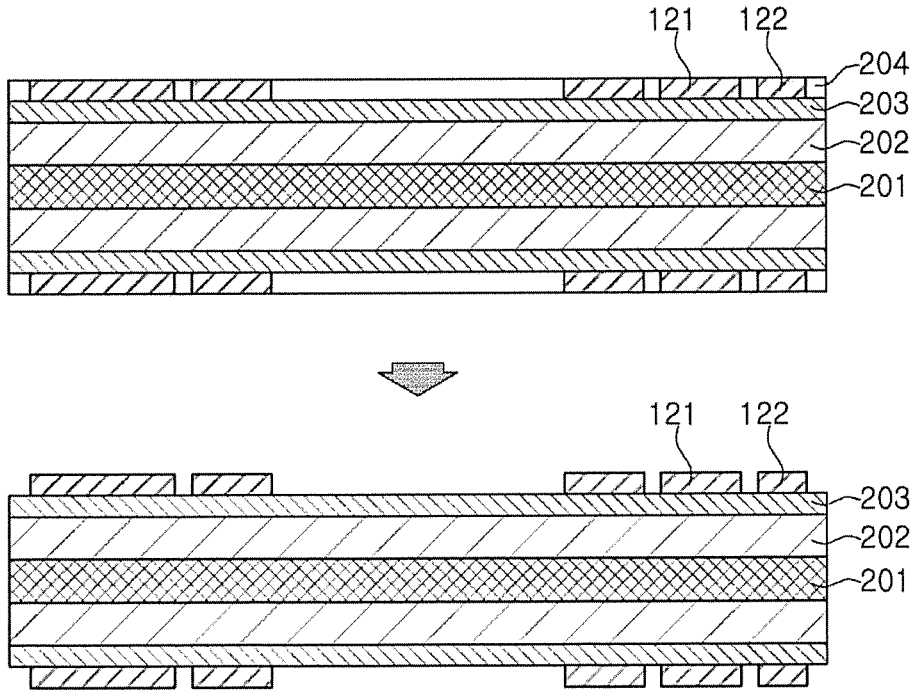

Then, as in a form illustrated in FIG. 6, the coil patterns 121 and the connection patterns 122 may be formed using the mask patterns 204. Then, the mask patterns 204 may be removed. The coil patterns 121 and the connection patterns 122 may be obtained by plating Cu, or the like. In this case, the coil patterns 121 and the connection patterns 122 may be formed on both of upper and lower surfaces of the carrier layer 201. Therefore, two unit laminates may be obtained by a single process.

Figure 7:
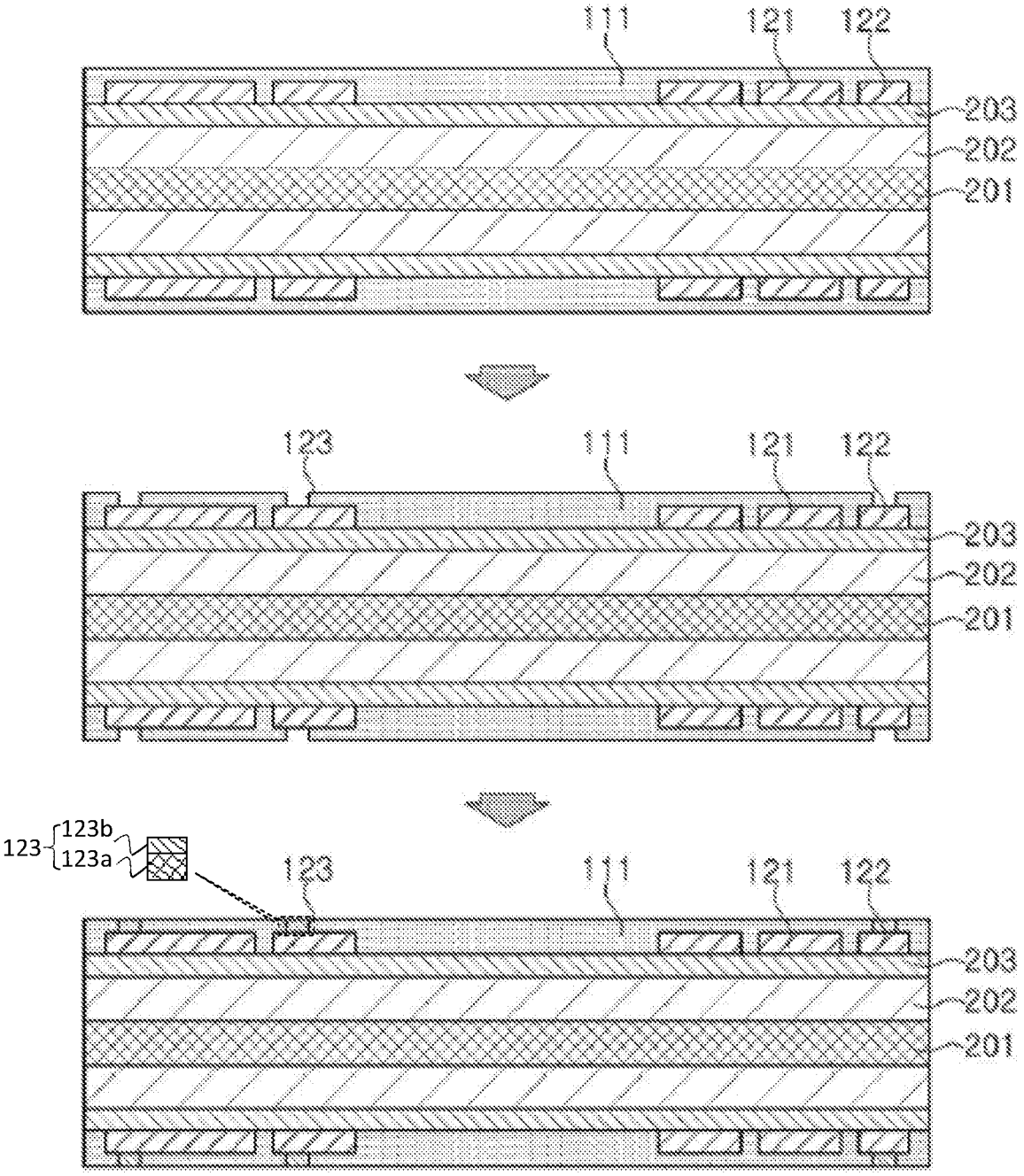

Then, as in a form illustrated in FIG. 7, the insulating layers 111 covering the coil patterns 121 and the connection patterns 122 may be formed, and the conductive vias 123 connected to the coil patterns 121 may be formed. The insulating layers 111 may be formed on both of the upper and lower surfaces of the carrier layer 201. As described above, the insulating layer 111 may be formed of a photosensitive insulating material, and may be applied using, for example, a vacuum laminator. In this case, the insulating layer 111 may have a thickness of about 10 to 80 μm, and may contain a metal or a ceramic filler depending on a required object. In addition, a hardening level of the insulating layer 111 may be adjusted by an amount of the photosensitive material included in the insulating layer 111, and the insulating layer may be formed of a mixture of two kinds of materials such as a mixture of a thermosetting material and a photosensitive material.

Then, the conductive vias 123 connected to the coil patterns 121 may be formed. To this end, the insulating layers 111 formed of the photosensitive insulating material may be exposed and developed using ultraviolet (UV) light, or the like, to form through-holes, and materials for forming the conductive vias 123, such as a Cu layer and an Sn layer may be plated to fill the through-holes to form the conductive vias 123 in a multilayer structure.

Figure 8:
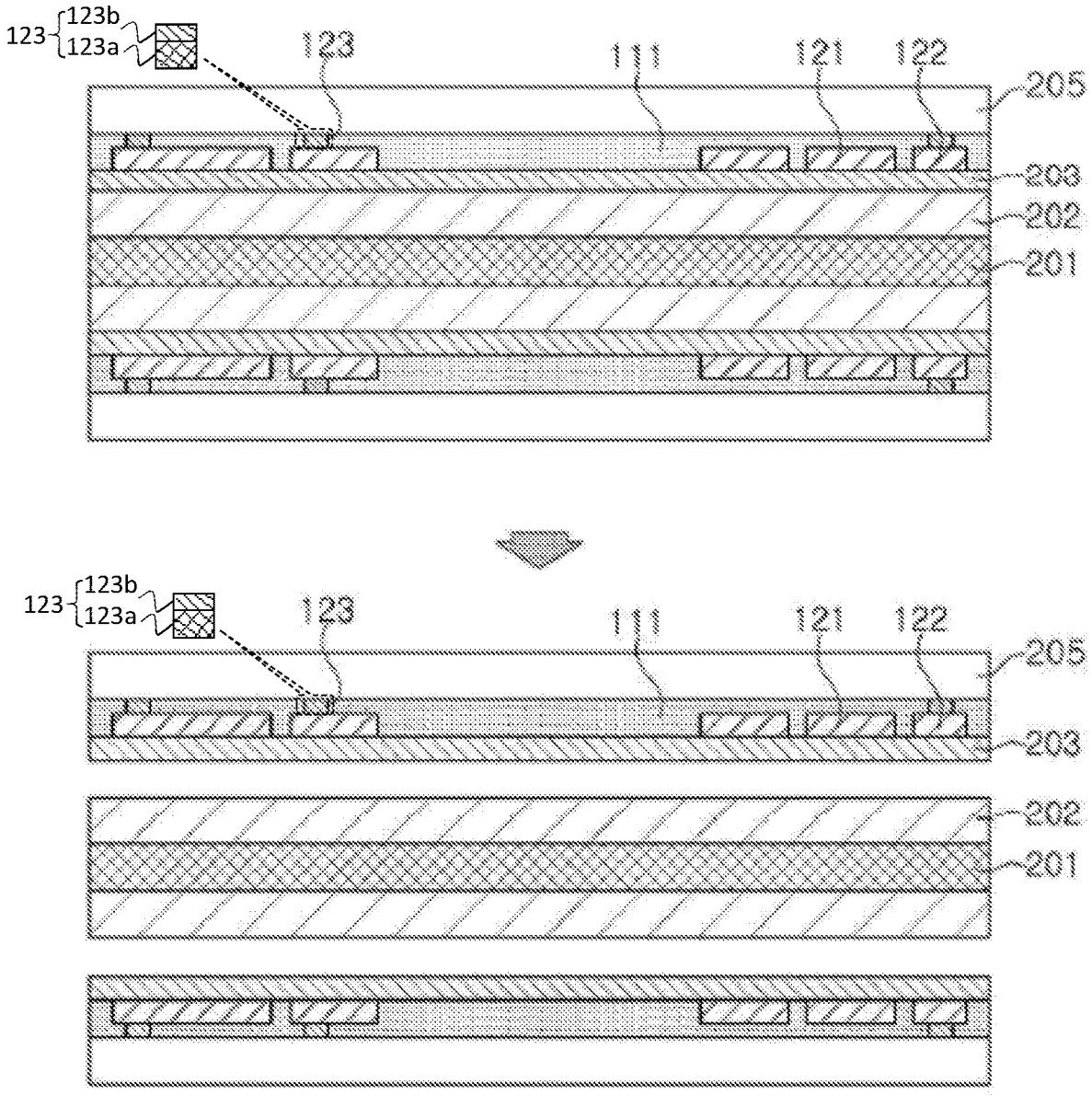

Then, as in a form illustrated in FIG. 8, the carrier layer 201 may be separated from the unit laminate including the insulating layers 111, the coil layers 120, and the conductive vias 123 obtained by the abovementioned processes. A support layer 205 may be formed on the insulating layer 111 for the purpose of the present separating process, if it is not necessary. In addition, when the copper foil layers 202 and 203 remain on the insulating layers 111, the coil layers 120, and the like, after the carrier layer 201 is separated, the remaining copper foil layers 202 and 203 may be removed by appropriately applying the etching process known in the related art.

Figure 9:
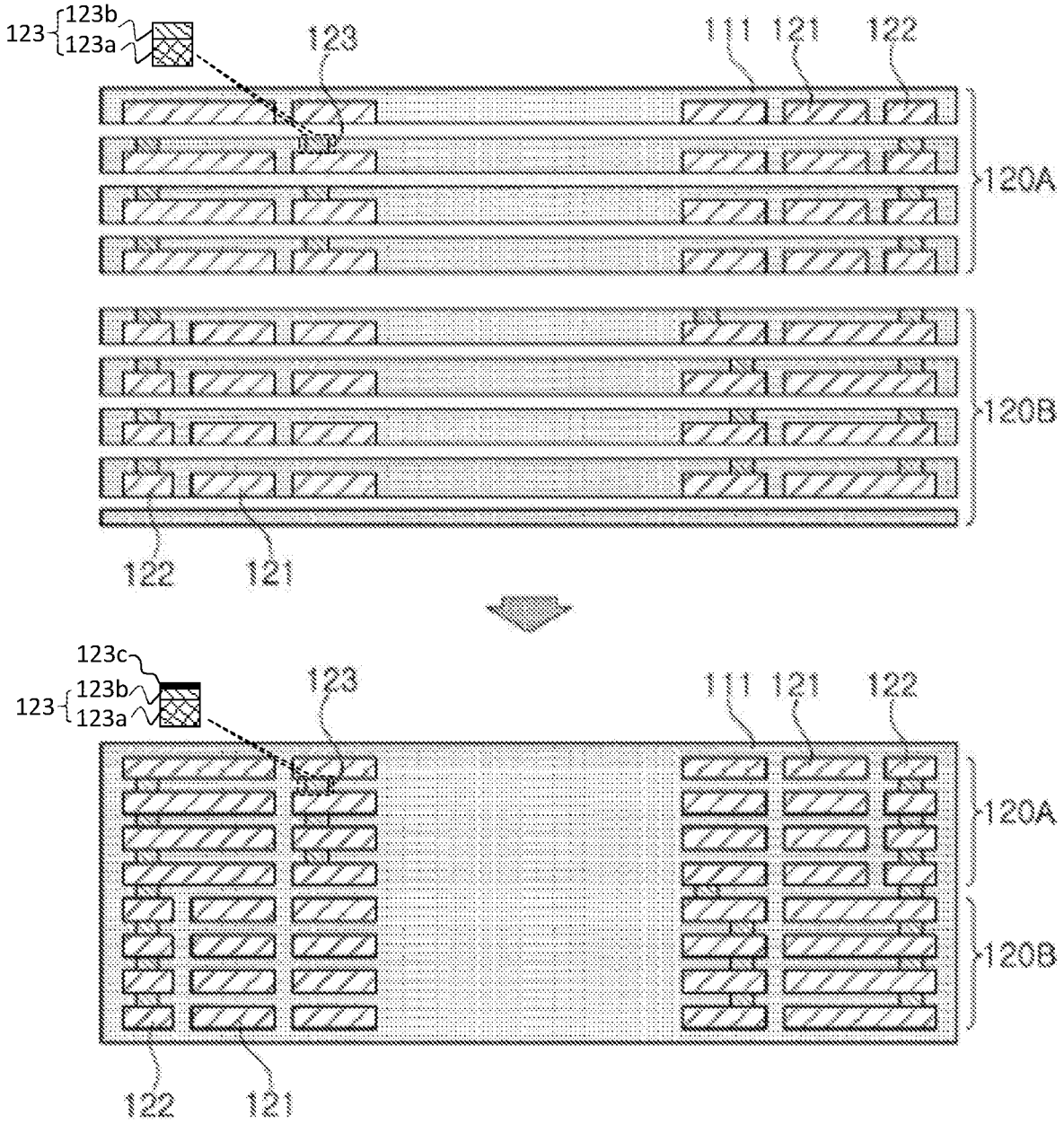

Then, as in a form illustrated in FIG. 9, a plurality of unit laminates that are individually obtained may be collectively stacked to correspond to one another. In this case, a stacking structure may be obtained by applying heat and pressure to the plurality of unit laminates. In the stacking structure obtained as described above, interlayer coupling may be stably implemented without performing a firing process.

As in the present exemplary embodiment, the unit laminates manufactured in advance may be stacked simultaneously to form a body, resulting in a reduction in the number of processes and a process time as compared to a method of sequentially stacking the respective layers, which leads to a reduction in a process cost. In addition, the method of manufacturing the coil electronic component according to the present exemplary embodiment may be advantageous ineffectively implementing specifications such as a size of the coil electronic component 100, electrical characteristics, and the like, by appropriately adjusting the number or thicknesses of coil layers 120. The plurality of unit laminates are stacked simultaneously in the present exemplary embodiment, but the plurality of unit laminates may also be stacked two or more times depending on the number of unit laminates.

Figure 10:
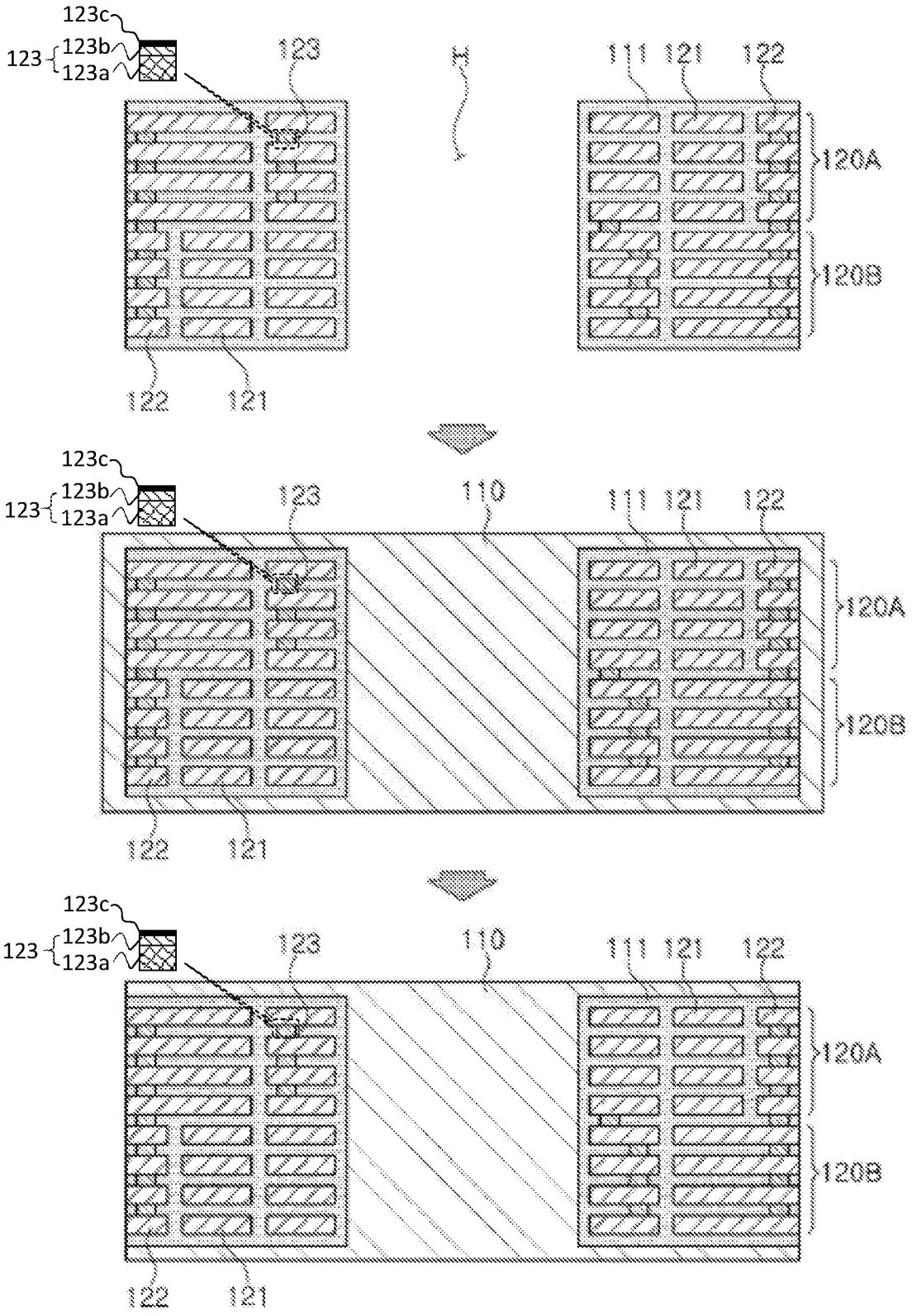

Then, as in a form illustrated in FIG. 10, a hole H may be formed in the insulating layers 111, and may be filled with a magnetic material, or the like, to form a core part 110. In this case, the core part 110 may be formed to cover side surfaces of the coil layers 120 and the insulating layers 111, and a process of removing the core part 110 by an appropriate polishing process may be additionally performed. However, a process of forming the core part 110 is not a necessarily required process in the present disclosure, but may be omitted according to another exemplary embodiment. Then, external electrodes connected to the coil layers 120 may be formed to obtain the coil electronic component as illustrated in FIG. 2.

As set forth above, when the coil electronic component according to the exemplary embodiment in the present disclosure is used, the coil electronic component may have a reduced thickness to be advantageous in terms of miniaturization and be implemented to have a high inductance, and such a coil electronic component may be effectively manufactured by a collective stacking method, or the like.

While exemplary embodiments have been shown and described above, it will be apparent to those skilled in the art that modifications and variations could be made without departing from the scope of the present invention as defined by the appended claims.

What is claimed is:

1. A coil electronic component comprising:

a plurality of coil layers including, respectively, coil patterns and connection patterns disposed outside the coil patterns and forming a stacking structure;

first conductive vias disposed between the coil patterns and connecting the coil patterns disposed on different levels to each other;

second conductive vias disposed between the connection patterns and connecting the connection patterns disposed on different levels to each other;

an intermetallic compound comprising Sn and disposed between the first conductive vias and the coil patterns, respectively, and between the second conductive vias and the connection patterns, respectively; and external electrodes disposed on surfaces of the stacking structure and electrically connected to the connection patterns exposed to the surfaces of the stacking structure, wherein the coil patterns of at least two of the plurality of coil layers have the same shape, and are electrically connected to each other in parallel.

2. The coil electronic component of claim 1, wherein distances between any immediately adjacent coil layers in a direction along which the plurality of coil layers are stacked are substantially the same as each other.

3. The coil electronic component of claim 1, wherein an insulating material between any immediately adjacent coil layers in a direction along which the plurality of coil layers are stacked is the same.

4. The coil electronic component of claim 1, wherein the coil layers include only first coil layers having a same first layout in a plan view along a stacking direction of the coil layers and second coil layers having a same second layout different from the first layout in the plan view along the stacking direction of the coil layers.

5. The coil electronic component of claim 1, wherein the intermetallic compound further comprises Cu.

6. The coil electronic component of claim 1, further comprising a first coil part and a second coil part, respectively including the plurality of coil layers, wherein coil patterns of the coil layers belonging to the first coil part have the same shape, and coil patterns of the coil layers belonging to the second coil part have the same shape.

7. The coil electronic component of claim 6, wherein the coil patterns of the coil layers belonging to the first coil part have a shape different from that of the coil patterns of the coil layers belonging to the second coil part.

8. The coil electronic component of claim 7, wherein the coil patterns of the coil layers belonging to the first coil part and the coil patterns of the coil layers belonging to the second coil part have a line symmetry shape with respect to each other.

9. The coil electronic component of claim 6, wherein each of the plurality of coil layers includes a pair of connection patterns, and the coil patterns of the coil layers belonging to the first coil part are connected to one of the pair of connection patterns and the coil patterns of the coil layers belonging to the second coil part are connected to the other of the pair of connection patterns.

10. The coil electronic component of claim 9, wherein the external electrodes include first and second external electrodes of which polarities are different from each other, and the connection patterns of the coil layers belonging to the first coil part are connected to the first external electrode and the connection patterns of the coil layers belonging to the second coil part are connected to the second external electrode.

11. The coil electronic component of claim 6, wherein the coil layers belonging to the first coil part are electrically connected to each other in parallel, and the coil layers belonging to the second coil part are electrically connected to each other in parallel.

12. The coil electronic component of claim 11, wherein the first coil part and the second coil part are electrically connected to each other in series.

13. The coil electronic component of claim 1, wherein each of the plurality of coil layers includes a pair of connection patterns.

14. The coil electronic component of claim 13, wherein the pair of connection patterns are disposed in positions opposing each other to face each other.

15. The coil electronic component of claim 14, wherein in each of the plurality of coil layers, one connection pattern of the pair of connection patterns is electrically connected to one of the external electrodes, and another connection pattern of the pair of connection patterns is electrically isolated from the remaining portion of the coil layer and is electrically connected to another of the external electrodes.

16. The coil electronic component of claim 1, further comprising insulating layers covering the coil patterns and the connection patterns.

17. The coil electronic component of claim 16, further comprising a core part filling a hole penetrating through the insulating layers and including a magnetic material.

18. The coil electronic component of claim 17, wherein the core part covers upper and lower portions of the plurality of coil layers.

19. A coil electronic component comprising:

a plurality of coil layers including, respectively, coil patterns and connection patterns disposed outside the coil patterns and forming a stacking structure;

first conductive vias disposed between the coil patterns and connecting the coil patterns disposed on different levels to each other;

second conductive vias disposed between the connection patterns and connecting the connection patterns disposed on different levels to each other; and external electrodes disposed on surfaces of the stacking structure and electrically connected to the connection patterns exposed to the surfaces of the stacking structure, wherein the coil patterns of at least two of the plurality of coil layers have the same shape, and are electrically connected to each other in parallel, and each of the first conductive vias and the second conductive vias includes a stacked structure of a Cu layer and an Sn layer.

20. A coil electronic component comprising:

a stacked structure including a plurality of coil layers and a plurality of insulating layers alternately stacked with the plurality of coil layers, the plurality of coil layers including, respectively, copper coil patterns and copper connection patterns disposed outside the coil patterns;

first conductive vias disposed between the coil patterns and connecting the coil patterns disposed on different levels to each other;

second conductive vias disposed between the connection patterns and connecting the connection patterns disposed on different levels to each other;

an intermetallic compound disposed between the first conductive vias and the coil patterns, respectively, and between the second conductive vias and the connection patterns, respectively; and external electrodes electrically connected to the plurality of coil layers, wherein the coil patterns of at least two of the plurality of coil layers have the same shape, and are electrically connected to each other in parallel, a copper coil pattern and a copper connection pattern of one of the plurality of coil layers each have upper and lower surfaces opposing each other, one of the first conductive vias extends from one of the upper and lower surfaces of the copper coil pattern of the one of the plurality of coil layers, one of the second conductive vias extends from one of the upper and lower surfaces of the copper connection pattern of the one of the plurality of coil layers, the upper surface of the copper coil pattern of the one of the plurality of coil layers is in direct contact with one of the plurality of insulating layers, and the upper surface of the copper connection pattern of the one of the plurality of coil layers is in direct contact with the one of the plurality of insulating layers, and the lower surface of the copper coil pattern of the one of the plurality of coil layers is in direct contact with another of the plurality of insulating layers, and the lower surface of the copper connection pattern of the one of the plurality of coil layers is in direct contact with the another of the plurality of insulating layers.

* * * * *